US007773923B2

(12) United States Patent
Hagiwara et al.

(10) Patent No.: US 7,773,923 B2
(45) Date of Patent: Aug. 10, 2010

(54) DEVELOPING APPARATUS AND IMAGE FORMING APPARATUS

(75) Inventors: Kazunari Hagiwara, Numazu (JP); Katsuhiro Sakaizawa, Numazu (JP); Norio Takahashi, Suntou-gun (JP); Rie Endo, Ashigarakami-gun (JP)

(73) Assignee: Canon Kabushiki Kaisha, Tokyo (JP)

( * ) Notice: Subject to any disclaimer, the term of this patent is extended or adjusted under 35 U.S.C. 154(b) by 227 days.

(21) Appl. No.: 12/118,286

(22) Filed: May 9, 2008

(65) Prior Publication Data

US 2009/0003863 A1 Jan. 1, 2009

(30) Foreign Application Priority Data

May 14, 2007 (JP) ..... 2007-128315
Apr. 2, 2008 (JP) ..... 2008-096419

(51) Int. Cl.
*G03G 15/08* (2006.01)

(52) U.S. Cl. ..... 399/281; 399/111; 399/119

(58) Field of Classification Search ..... 399/107, 399/110, 111, 119, 120, 252, 265, 279, 281–286
See application file for complete search history.

(56) References Cited

U.S. PATENT DOCUMENTS 5,570,166 A 10/1996 Ohzeki et al.
5,970,279 A 10/1999 Sakaizawa et al.
6,376,087 B1 4/2002 Ozeki et al.
6,560,426 B2 5/2003 Sakaizawa et al.
6,711,372 B1 * 3/2004 Noda et al. ..... 399/286
6,751,423 B2 6/2004 Sakaizawa et al.
7,313,350 B2 12/2007 Yamamura
2006/0257175 A1 11/2006 Endo et al.
2007/0098459 A1 5/2007 Endo et al.
2009/0169270 A1 * 7/2009 Fuwa et al. ..... 399/279

* cited by examiner

*Primary Examiner*—Hoan Tran
(74) *Attorney, Agent, or Firm*—Fitzpatrick, Cella, Harper & Scinto

(57) ABSTRACT

A developing apparatus in which a toner has a volume-average particle diameter R that is in a range of 4.0 μm≦R≦6.2 μm, a developing roller has an arithmetic mean roughness Ra (μm) that is not more than 0.10 times the volume-average particle diameter R of the toner, a voltage applied to a supply roller is of negative polarity, that is, a normal charging polarity of the toner, triboelectrification polarity of the supply roller with respect to the toner is negative, that is, of the normal charging polarity of the toner, and an abutment width S in which the developing roller and the supply roller abut each other is in a range of 2.5 mm≦S≦5.5 mm.

9 Claims, 8 Drawing Sheets c) FOG AMOUNT EVALUATION AFTER ENDURANCE b) HALF TONE IMAGE·UNIFORMITY IMAGE EVALUATION d) GHOST IMAGE FAILURE EVALUATION AFTER ENDURANCE

COMPREHENSIVE EVALUATION OF b) HALF TONE IMAGE UNIFORMITY, c) FOG AFTER ENDURANCE, AND d) GHOST IMAGE FAILURE AFTER ENDURANCE

DEVELOPING APPARATUS AND IMAGE FORMING APPARATUS

BACKGROUND OF THE INVENTION

1. Field of the Invention

The present invention relates to an image forming apparatus, such as a copying machine or a printer, having the function of forming an image on a recording medium, such as a sheet, and more particularly, to a developing apparatus to be provided in such an image forming apparatus.

2. Description of the Related Art

As a conventional development system using a mono-component developer (toner), there has been proposed a contact development system using a developing roller equipped with an elastic layer. In connection with the contact development system, there have been proposed several toner regulating members for forming a thin layer of mono-component toner on a developer carrying member. One of these toner regulating members is described with reference to FIG. 11.

FIG. 11 is a diagram illustrating a contact development system using a developing roller having an elastic layer.

The construction as described below is well known as a contact development system. A developing roller 103 is an elastic roller having a dielectric layer. A nonmagnetic developer is carried on the developing roller 103, which is held in contact with the surface of a photosensitive drum 101 through the intermediation of the nonmagnetic developer. The supply of developer to the developing roller 103 is effected by a supply roller 105 held in contact with the developing roller 103. The supply roller 105 has the function of conveying developer from within a developing container T to the developing roller 103 and of temporarily removing the developer remaining on the developing roller 103.

The layer regulation of the developer adhering to the developing roller 103 and the imparting of electric charge through triboelectrification are effected by causing a toner regulating member 104 to abut the developing roller 103. As an example of the toner regulating member 104, there has been proposed a member of a blade-like configuration formed by a metal thin plate supported in a cantilever-like fashion, with the surface of the metal thin plate abutting the developing roller 103. The developing roller 103 is coated with developer by the toner regulating member. The developer used for the coating serves to develop an electrostatic latent image, formed on the photosensitive drum 101, into a toner image through the electrical potential of a bias applied to the developing roller 103.

Further, in recent years, in order to achieve higher image quality, there has been proposed a reduction in the particle diameter of the toner (see, for example, U.S. Pat. No. 7,313,350).

However, the conventional technique described above has the following problem.

In a developing apparatus adopting the contact development system and using toner of small particle diameter, it is rather difficult to form a coating layer on the developing roller in a stable manner when there is a change in the environment or an increase in the number of sheets on which printing is to be performed. In order to supply toner to the developing roller in a stable manner, it is necessary to increase the surface roughness of the developing roller and to increase the regulating force of the regulating member. This, however, leads to promotion of degeneration of the toner, a marked reduction in durability, and image failure.

Thus, it is difficult to attain both higher image quality and higher durability.

SUMMARY OF THE INVENTION

In view of the above problem, the present invention provides a developing apparatus including: a developer carrying member for carrying a developer; a developer amount regulating member for regulating the developer on the developer carrying member; and a developer supplying member provided so as to abut the developer carrying member and for supplying the developer to the developer carrying member. The developer used has a volume-average particle diameter R that is in a range of 4.0 μm≦R≦6.2 μm, and a surface of the developer carrying member has an arithmetic mean roughness Ra (μm) that is not more than 0.10 times the volume-average particle diameter R of the developer. The voltages are respectively applied to the developer supplying member and the developer carrying member. The voltage applied to the developer supplying member is of the same polarity as the normal charging polarity of the developer on the developer carrying member after regulation by the developer amount regulating member with respect to the voltage applied to the developer carrying member. The triboelectrification polarity of the developer supplying member with respect to the developer is of the same polarity as the normal charging polarity of the developer. And in a cross section taken in a direction in which the developer carrying member and the developer supplying member abut each other, an abutment width S in which the developer carrying member and the developer supplying member abut each other is in a range of 2.5 mm≦S≦5.5 mm.

According to the present invention, high image quality is achieved through use of a developer of small particle diameter, and it is possible to suppress a reduction in durability and image failure, which have been a problem involved when a developer of small particle diameter is used. The present invention is described in detail below.

Further features of the present invention will become apparent from the following description of exemplary embodiments with reference to the attached drawings.

DESCRIPTION OF THE EMBODIMENTS

In the following, an exemplary embodiment for carrying out the present invention is described in detail by way of example with reference to the drawings. It should be noted that the dimensions, materials, and configurations of the components of this embodiment and the relative arrangement thereof are to be changed as appropriate, according to the construction of the apparatus to which the invention is applied, and according to various other conditions, and that the scope of the present invention is not restricted to that of the following embodiment.

(Construction of Main Body)

Figure 2:
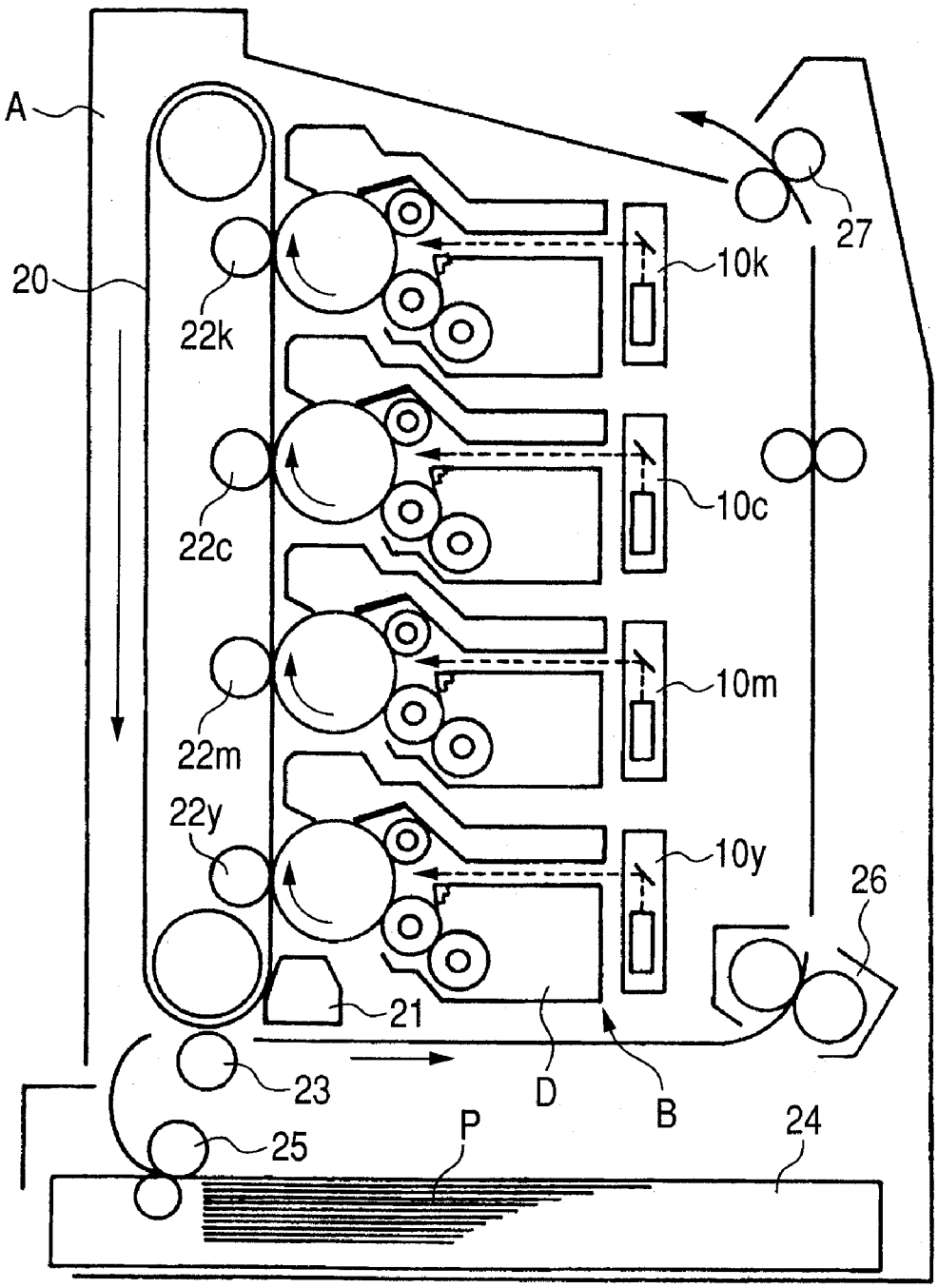
FIG. 2 is a schematic view of an image forming apparatus according to an embodiment of the present invention.

FIG. 2 is a schematic view illustrating the construction of an image forming apparatus using a developing apparatus according to an embodiment of the present invention.

An image forming apparatus A, as illustrated in FIG. 2, is a full color laser printer utilizing the electrophotographic process. In the following, the general construction of the image forming apparatus A of this embodiment is described.

Figure 3:
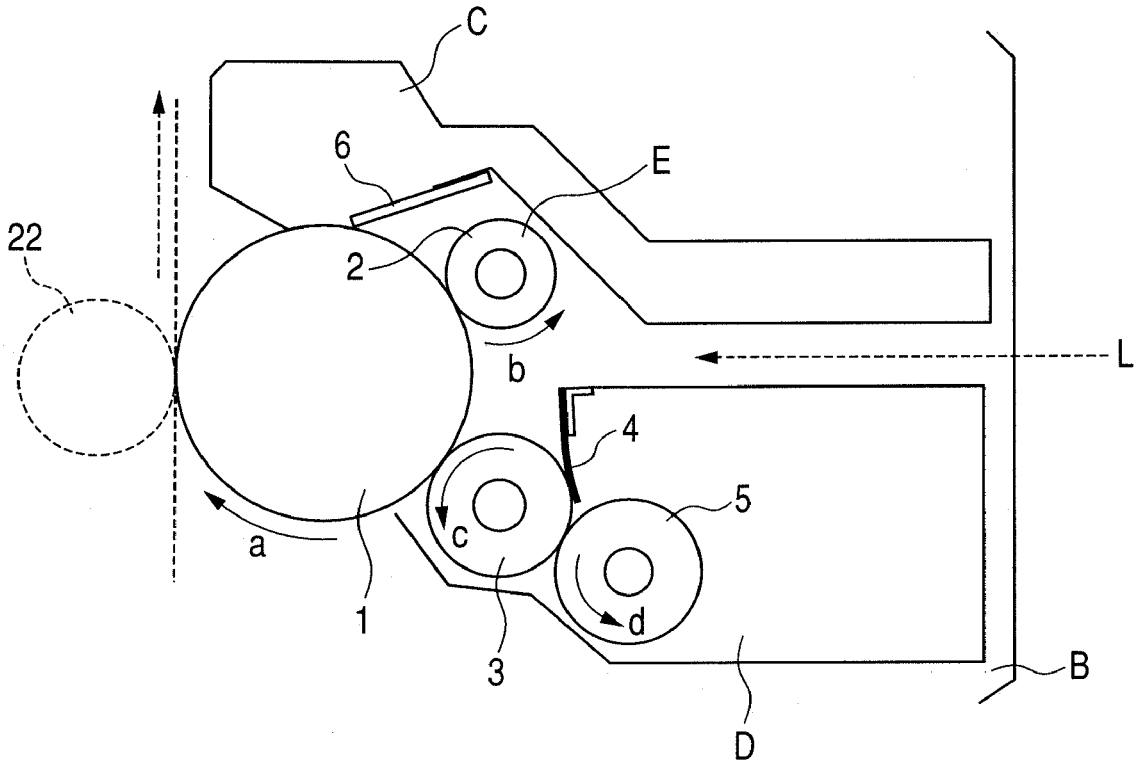
FIG. 3 is a schematic view of a process cartridge according to an embodiment of the present invention.

The image forming apparatus A is equipped with four process cartridges B for yellow, magenta, cyan, and black colors, arranged side by side, each being formed by integrating a charging device E, as illustrated in FIG. 3, a developing apparatus D, a cleaning device C, and a photosensitive drum 1 as an image bearing member. Further, toner (developer) images formed by the process cartridges B of the different colors are transferred to an intermediate transferring belt 20 serving as a transfer member, whereby a full color image is formed. The image forming process in each process cartridge B is described in detail below. Here, the process cartridges B are provided so as to be detachable with respect to the image forming apparatus main body. In each process cartridge B, it is only necessary for the developing apparatus D and the photosensitive drum 1 to be integrated as components. The colors of the toners may include chromatic colors as in the case described above, but is not limited to such.

The toner images formed on the photosensitive drums 1 by the process cartridges B of the different colors are transferred to the intermediate transferring belt 20 by primary transfer rollers 22*y*, 22*m*, 22*c*, and 22*k* respectively opposed to the photosensitive drums 1 for the different colors, with the intermediate transferring belt 20 therebetween. Further, the toner images transferred to the intermediate transferring belt 20 are collectively transferred to a recording material by a secondary transfer roller 23 provided on the downstream side with respect to the moving direction of the intermediate transferring belt 20. The untransferred toner remaining on the intermediate transferring belt 20 is recovered by an intermediate transferring belt cleaner 21.

The recording materials P are stacked in a cassette 24 in the lower portion of the image forming apparatus A. When there is a request for printing operation, a recording material is conveyed by a feeding roller 25, and toner images formed on the intermediate transferring belt 20 are transferred to the recording material at the position of the secondary transfer roller 23.

After that, the toner images on the recording material are fixed to the recording material by a fixing unit 26 through heating, and the recording material is delivered to the exterior of the image forming apparatus A by way of a delivery portion 27.

In the image forming apparatus A, the upper unit accommodating the process cartridges B of the four colors and the transfer unit, and the lower unit accommodating the recording materials, are separable. When jamming or the like occurs, or when the process cartridges B are to be replaced, the upper and lower units are opened to allow the requisite operation.

In the image forming apparatus A of this embodiment, the service life of the process cartridges B, in terms of toner capacity, corresponds to 20,000 sheets of A-4 size, on which printing is performed by a coverage rate of 5%.

Next, the image forming process in the process cartridges B is described.

FIG. 3 is a sectional view of one of the four process cartridges B arranged in parallel and the vicinity thereof.

As the photosensitive drum 1, which serves as a key member for the image forming process, there is used an organic photoconductive drum, which is formed by sequentially coating the outer peripheral surface of an aluminum cylinder with functional films, that is, an undercoat layer, a carrier generation layer, and a carrier transfer layer. During the image forming process, the photosensitive drum 1 is driven at a predetermined speed in the direction indicated by the arrow "a" in FIG. 3 by the image forming apparatus A.

The charging roller 2, which serves as the charging device, has a conductive rubber roller portion held in pressure contact with the photosensitive drum 1, and is driven to rotate in the direction indicated by the arrow "b". Here, as a charging process, a DC voltage of −1100 V is applied to the metal core of the charging roller 2 for the photosensitive drum 1, and, due to the electric charge thereby induced, a uniform dark portion potential (Vd) of −550 V is formed on the surface of the photosensitive drum 1.

The spot pattern of a laser beam is applied from a scanner unit 10 in correspondence with the image data to this uniform surface charge distribution surface, whereby the photosensitive drum 1 is exposed as indicated by the arrow L in FIG. 3. In the exposed portion of the photosensitive drum 1, the surface electric charge disappears due to carriers from the carrier generation layer, resulting in a reduction in potential. As a result, there is formed on the photosensitive drum 1 an electrostatic latent image, of which the exposed portion exhibits a light portion potential Vl of −100 V and the non-exposed portion exhibits a dark portion potential Vd of −550 V.

The electrostatic latent image is developed into a toner image by the developing action of a developing apparatus D having developing roller 3 with a toner coating layer of a predetermined coating amount and electric charge amount.

The method of forming the toner layer, which is to be described below, is described here schematically. While held in contact with the photosensitive drum 1, the developing roller 3 rotates in the forward direction as indicated by the arrow "c". In this embodiment, in the developing portion held in contact with the photosensitive drum 1, the toner negatively charged, due to a DC bias of −350 V applied to the developing roller 3, is transferred solely to the light potential portions, thus visualizing the electrostatic latent image due to the difference in potential.

The intermediate transferring belt 20 held in contact with the photosensitive drums 1 of the process cartridges B are pressed against the photosensitive drums 1 by the primary transfer rollers 22*y*, 22*m*, 22*c*, and 22*k*, respectively, opposed to the photosensitive drums 1. Further, a DC voltage is applied to the primary transfer rollers 22*y*, 22*m*, 22*c*, and 22*k* to form electric fields between them and the photosensitive drums. As a result, in the transfer regions where the above-mentioned pressure contact is effected, the toner images visualized on the photosensitive drums 1 are transferred from the photosensitive drums 1 to the intermediate transferring belt 20 by the respective forces of the electric fields.

On the other hand, the untransferred toner remaining on the photosensitive drums 1 without being transferred to the intermediate transferring belt 20 is scraped off from the drum surfaces by cleaning blades 6 of urethane rubber installed in the cleaning devices C, and is accommodated in the cleaning devices C.

EXPERIMENTAL EXAMPLES AND COMPARATIVE EXAMPLES

First, in order to clarify the advantages of this embodiment, experimental examples to which this embodiment is applied and comparative examples are described below.

Experimental Example 1

Figure 1A:
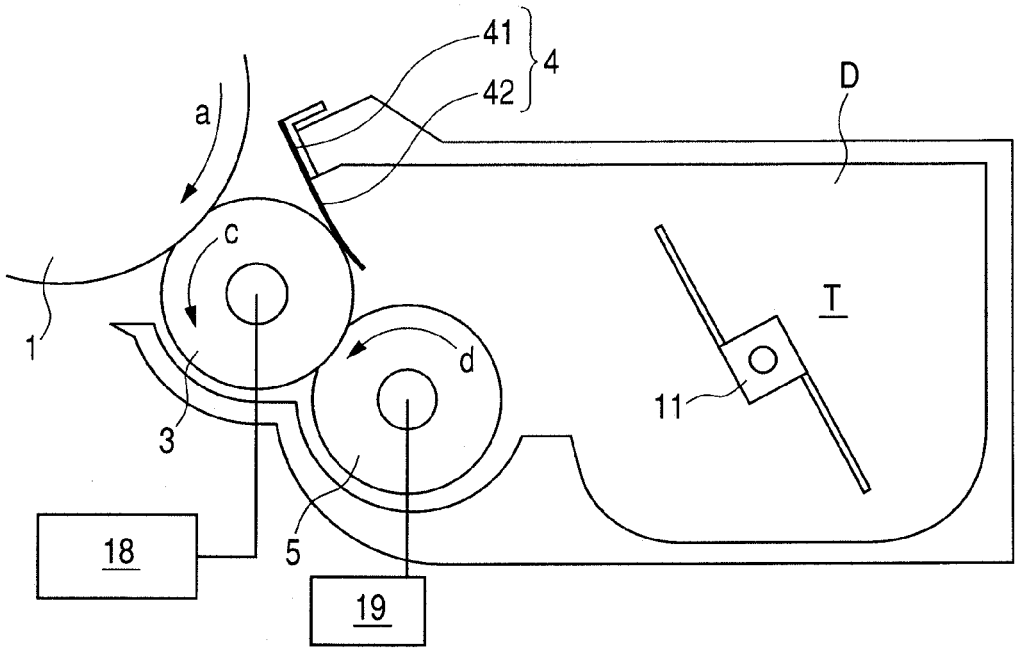
FIGS. 1A and 1B are schematic views of a developing apparatus according to Experimental Example 1 of the present invention.

FIG. 1A is a schematic sectional view of a developing apparatus according to Experimental Example 1 of the present invention.

The developing apparatus is equipped with a developing container, a developing roller 3 as the developer carrying member, a supply roller 5 as the developer supplying member, and an agitating member 11. Here, the developing container accommodates a nonmagnetic mono-component toner T as the developer. The developing roller 3 rotates in the forward direction "c" while held in contact with the photosensitive drum 1. The supply roller 5 rotates in the reverse direction "d" while in contact with the developing roller 3. The agitating member 11 serves to agitate the toner T.

Further, there is provided a toner regulating member 4 which abuts the developing roller 3 on the downstream side of the supply roller 5 with respect to the rotating direction "c" of the developing roller 3 and which serves as a developer amount regulating member for regulating the amount of developer in front of the developing portion. The toner regulating member 4 is provided for the purpose of controlling the toner on the developing roller 3 to a predetermined coating amount and to a predetermined electric charge amount suitable for the development on the photosensitive drum 1.

(Production of Toner T)

The mono-component nonmagnetic toner T as the developer is tailored by suspension polymerization using binder resin and charge controlling agent, and is prepared by adding fluidizing agent or the like as an extraneous additive.

As the binder resin, it is possible to use a well-known binder resin used for toner particles. Examples of the binder resin include styrene, and vinyl type resin, such as monomer or copolymer containing methacrylate ester as monomer.

When controlling the toner to charge it negatively, organometallic complex and chelate compound are effective as the charge controlling agent. Examples of such a charge controlling agent include salicylic acid, naphthoic acid, dicarboxylic acid, a metal compound of a derivative thereof, a high molecular compound with sulfonic acid in side chain, a boron compound, a urea compound, a silicon compound, calixarene, a monoazo metal complex, an acetylacetone metal complex, aromatic hydroxy carboxylic acid, and an aromatic dicarboxylic acid type metal complex.

When the toner is controlled to be positively charged, examples of the charge controlling agent include substances modified by aliphatic metal salt or the like; quaternary ammonium salt, such as tributyl benzyl ammonium-1-hydroxy-4-naphthosulfonate and tetrabutyl ammonium tetrafluoroborate, and onium salt, such as phosphonium salt which is an analog thereof; amine and polyamine type compounds; higher fatty acid metal salt; acetyl acetone metal complex; diorgano tin oxide, such as dibutyl tin oxide, dioctyl tin oxide, and dicyclohexyl tin oxide; and diorgano tin borate, such as dibutyl tin borate, dioctyl tin borate, and dicyclohexyl tin borate.

The amount of the charge controlling agent used is 0.1 to 15.0 parts by mass, more preferably, 0.1 to 10.0 parts by mass with respect to 100 parts by mass, of the binder resin component.

As inorganic fine particles to be contained in the surface of the toner particles as the extraneous additive, it is possible to use the following substances: oxide powder of silicon, magnesium, zinc, aluminum, titanium, cobalt, zirconium, manganese, cerium, strontium and the like; oxide powder of composite metal, such as calcium titanate, magnesium titanate, strontium titanate, and barium titanate; carbide of boron, silicon, titanium, vanadium, zirconium, molybdenum, tungsten, and the like; carbonate, sulfate, phosphate, or the like of magnesium, calcium, strontium, barium, and the like. Such well-known inorganic fine particles influencing the fluidity characteristic of the toner may be used singly or in a combination of at least two kinds of these materials. Above all, from the viewpoint of improving the fluidity of the toner, silica powder is preferable. (In particular, silica fine particles are preferable.) Further, it is desirable for the silica powder to be contained in the toner surface.

The amount of extraneous additive used is 0.1 to 5.0 parts by mass, and more preferably, 0.5 to 3.0 parts by mass, with respect to 100 parts by mass of toner particles. The volume-average particle diameter R of the toner prepared was 5.5 μm.

Here, the volume-average particle diameter R was calculated from a volume-based particle size distribution obtained through measurement of a particle diameter of 0.04 to 2000 μm by LS-230 type laser diffraction particle size distribution measurement apparatus manufactured by Beckman Coulter Co., Ltd. with a liquid module attached thereto.

In this Experimental Example, by adopting a toner volume-average particle diameter R of 4.0 μm to 6.2 μm, (4.0 μm≦R≦6.2 μm), it is possible to achieve high image quality and, at the same time, the effects of this Experimental Example. When the volume-average particle diameter of the toner exceeds 6.2 μm, a textured surface is generated on a halftone image, whereas, when it is less than 4.0 μm, a stable coating cannot be applied on the developing roller, resulting in deterioration in image quality.

The toner is adjusted so as to attain negative charge with respect to a metal, such as SUS or phosphor bronze; in this Experimental Example, the normal charging polarity of the toner is negative. The normal charging polarity of the toner refers to the charging polarity of the toner contributing to the formation of a toner image.

(Toner Regulating Member)

The toner regulating member 4 includes a support sheet metal 41 fixed to the developing container, and a thin-plate-like elastic member 42 of phosphor bronze, stainless steel, or the like supported in a cantilever-like fashion, with the surface of the thin-plate-like elastic member 42 abutting the developing roller 3. In this Experimental Example, an iron plate having a thickness of 1.2 mm is used as the support sheet metal, and a phosphor bronze plate having a thickness of 120 μm is bonded to the support sheet metal as a thin-plate-like elastic member 490. The distance from the cantilever-like support portion of the thin-plate-like elastic member 42 to the abutting portion of the developing roller 3, that is, the so-called free length, is 20 mm, and the forcing-in amount of the developing roller 3 with respect to the thin-plate-like elastic member 42 is 1.5 mm.

(Developing Roller)

Next, as the developing roller 3 serving as the developer carrying member of this Experimental Example, an elastic roller of a diameter of 16 mm was used, obtained by forming an conductive elastic layer that is 3 mm thick on a metal core having an outer diameter of 6 mm; as the material of the elastic layer, a silicone rubber of a volume resistance value of $10^6$ Ωm was used. The resistance value of the developing roller 3 was calculated from the current value when a DV voltage of 100 V was applied between the metal core of the developing roller 3 and a stainless steel cylindrical member with an outer diameter of 30 mm, which were opposed to each other while in contact with each other. The measurement environment was as follows: 23.0° C. and 50% RH.

It is also possible to provide the surface layer of the elastic roller with a coating layer or the like having the function of imparting electric charge to the developer. In this Experimental Example, in order to allow the elastic layer to be brought into elastic contact with the photosensitive drum 1 in a stable manner, the hardness of the elastic layer was set to 45°. Here, the hardness of the developing roller elastic layer was measured with a load of 1 kg applied thereto by the Asker-C hardness meter manufactured by Kobunshi Keiki, Co. Ltd.

The arithmetic mean roughness Ra as the surface roughness of the developing roller 3 was set to 0.1. In this Experimental Example, the measurement of the surface roughness Ra was measured according to JIS B0601 by using the surface roughness testing machine SE-30 manufactured by Kosaka Laboratory Ltd.

(Supply Roller)

In this Experimental Example, as the supply roller 5, an elastic sponge roller was used, obtained by forming a conductive elastic layer having a thickness of 5.5 mm and exhibiting a foam skeleton structure on a metal core having an outer diameter of 5 mm, and, for the elastic layer, there is used a polyurethane foam of a volume resistance value of $10^7$ Ωm was used. The resistance value of the supply roller was measured by the same method as in the case of the developing roller.

The supply roller 5 abuts the developing roller 3, and, due to the appropriate asperity feature of the foam surface, it supplies toner onto the developing roller 3 and scrapes off toner remaining without being consumed at the time of development. The scraping property due to this cell structure is not restricted to urethane foam; it is also possible to use a foam rubber obtained through foaming of silicone rubber, ethylene propylene diene rubber (EPDM rubber), or the like.

Figure 10:
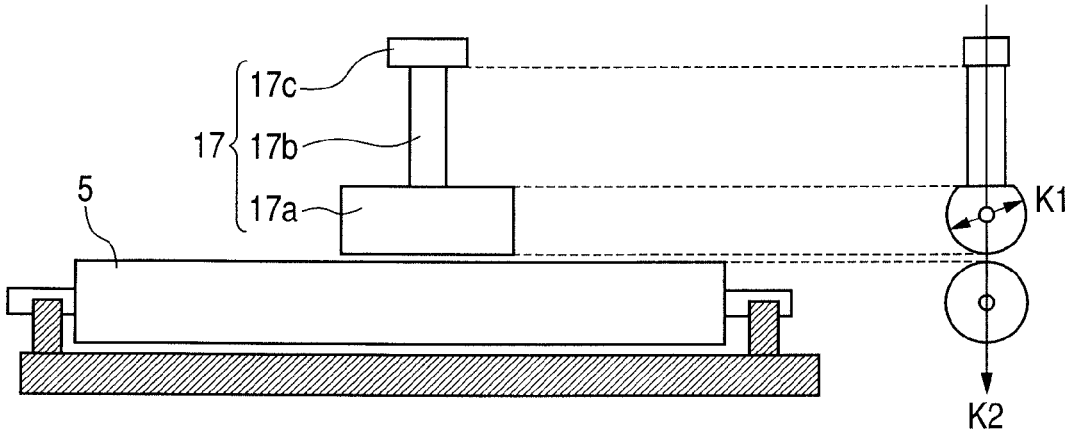
FIG. 10 is a schematic view for illustrating a method of measuring the hardness of an elastic layer of a supply roller.
Figure 11:
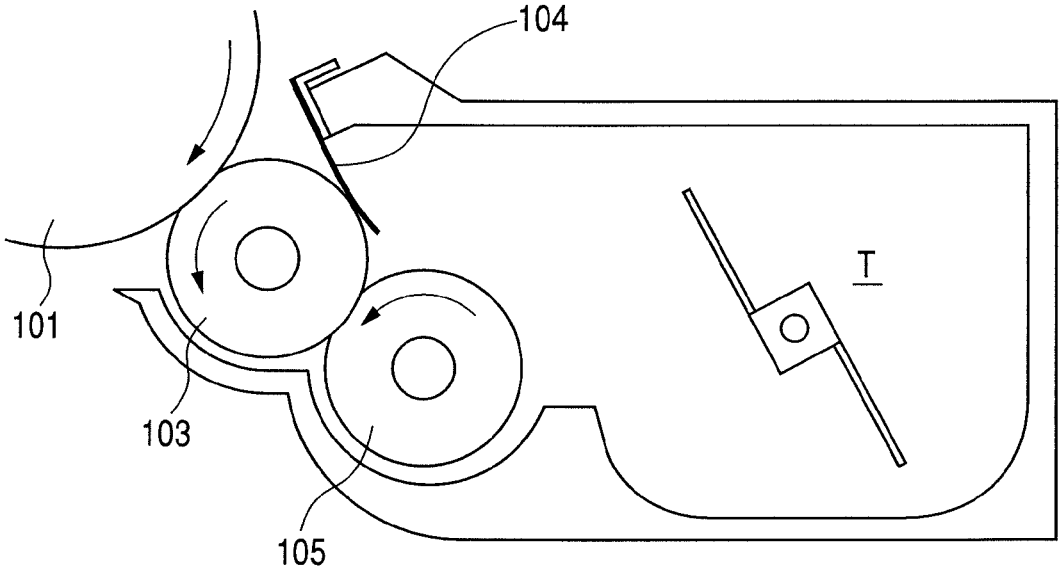
FIG. 11 is a schematic view for illustrating a conventional contact development system.

The hardness of the elastic layer was measured by the following method. FIG. 10 is a schematic view for illustrating a method of measuring the hardness of the elastic layer of the supply roller 5.

As illustrated in FIG. 10, in this Experimental Example, the forcing-in member 17 is equipped with a cylindrical portion 17*a* to be brought into contact with the supply roller 5, and an arm portion 17*b* provided in a region where it is not brought into direct contact with the supply roller surface, with the arm portion 17*b* being connected to a pressure sensor. The pressure generated when the forcing-in member 17 was forced into the supply roller surface was measured.

More specifically, because the developing roller 3 has an outer diameter of 16 mm, there was used a forcing-in member cylindrical portion 17*a* with an aluminum column having an outer diameter of 16 mm and a length of 50 mm. Further, the forcing-in was effected such that the central axis of the supply roller 5 and the central axis of the forcing-in member cylindrical portion 17*a* are in the same straight line, and the pressure when compression was effected by 1.0 mm at a rate of 1.0 mm/sec. was measured; the pressure per unit length was regarded as the hardness of the supply roller elastic layer.

In this Experimental Example, the hardness of the elastic layer is 0.040 N/mm.

(Developing Roller/Supply Roller)

Figure 1B:
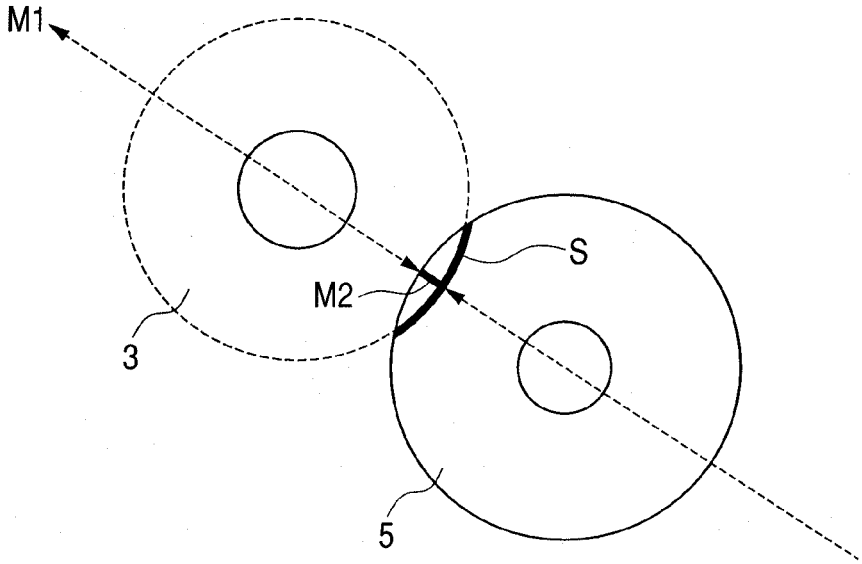

The overlapping amount of the supply roller surface prior to the incorporation of the developing roller and of the developing roller surface after the incorporation of the developing roller (indicated at M2 in FIG. 1B), that is, the so-called "inroad amount", was set to 1.0 mm. At this time, as illustrated in FIG. 1B, the direction in which the forcing-in was effected was in a direction parallel with a straight line M1 passing the metal core central axes of the rollers. Further, as illustrated in FIG. 1B, at this time, the abutment width S of the developing roller 3 and the supply roller 5 was 4.0 mm. Here, as illustrated in FIG. 1B, the abutment width S was measured by observing in section the way the developing roller 3 and the supply roller 5 abut each other. That is, when a section is taken in the abutment direction in which the developing roller 3 and the supply roller 5 abut each other, the abutment width is the width in which the developing roller 3 and the supply roller 5 abut each other. The abutment direction is a direction (forcing-in direction) in which the developing roller 3 and the supply roller 5 are caused to overlap (inroad) and in which a pressure (abutment pressure) is exerted through the abutment of the developing roller 3 and the supply roller 5, that is, the direction indicated by the straight line M1 in FIG. 1B.

As in the case of the hardness of the elastic layer, the pressure (abutment pressure) generated at the time of abutment of the developing roller 3 and the supply roller 5 was measured by the forcing-in member 17. Unlike the measurement of the hardness of the elastic layer, the pressure per unit length with respect to the actual inroad amount was regarded as the abutment pressure.

In this Experimental Example, setting was made such that the abutment pressure when the inroad amount was 1.0 mm was 0.040 N/mm.

(Triboelectrification Polarity of Supply Roller with respect to Toner)

The triboelectrification polarity of the supply roller 5 with respect to the toner was measured by a method described below in which the toner and the supply roller are rubbed against each other; in this Experimental Example, adjustment was made such that the supply roller 5 was negatively charged (the same polarity as the normal charging polarity of the toner). This means that the supply roller 5 causes the toner to be positively charged, that is, to a polarity reverse to the normal charging polarity.

The triboelectrification polarity of this Experimental Example was examined as follows.

First, the supply roller 5 and an appropriate amount of toner were extracted from within the developing container. By performing compression molding on the extracted toner, there was prepared a pellet having a thickness of 1.0 mm. The toner on the supply roller 5 was removed through suction and blowing, placing the supply roller in a state in which no toner adhered to the roller surface. After that, while rotating the supply roller 5, the pellet was rubbed against the surface of the supply roller, and measurement was performed by using the surface potential of the supply roller 5 after the rubbing, whereby the charging polarity of the supply roller 5 was examined. For the measurement, there was used the surface potential meter MODEL 344 manufactured by Trek Japan Co. Ltd.

The adjustment of the charging polarity of the supply roller 5 was effected through kneading of fluororesin, vinyl chloride resin, polyolefin resin, epoxy resin, or the like.

While in this Experimental Example the above-mentioned materials are kneaded since the normal charging polarity of the toner is negative. When the normal charging polarity is positive, the adjustment can be effected by silicone rubber, a polyamide resin, a melamine resin, a polyurethane resin, an acrylic resin, or the like.

(Bias Application)

A voltage of −300 V is applied to the developing roller metal core, and a voltage of −500 V is applied to the toner regulating member 4. Thus, the voltage applied to the toner regulating member 4 is on the negative side by 200 V with respect to that applied to the developing roller 3. Further, a voltage of −600 V is applied to the metal core of the supply roller, which means that the voltage applied to the supply roller is on the negative side by 300 V with respect to that applied to the developing roller 3. Here, the image forming apparatus A is provided with power sources 18 and 19 which serve as voltage application units for applying voltage to the developing roller 3, the toner regulating member 4, and the supply roller 5.

In this way, the voltages applied to the supply roller 5 and the toner regulating member 4 are both on the negative side with respect to that applied to the developing roller 3, which is the normal charging polarity of the toner. In particular, in this Experimental Example, the voltage applied to the supply roller 5 is of the same polarity (negative polarity) as the normal charging polarity of the toner on the developing roller 3 after the regulation by the toner regulating member 4 with respect to the voltage applied to the developing roller 3.

Comparative Example 1

While the developing apparatus of this comparative example is basically the same as that of Experimental Example 1, it differs therefrom in the following points.

The difference lies in the fact that the toner volume-average particle diameter is 7.0 μm and the developing roller surface roughness Ra is 3.0 μm, i.e., Ra/R=0.43, and that the charging polarity of the supply roller with respect to the toner is positive.

Comparative Example 2

While the developing apparatus of this comparative example is basically the same as that of Experimental Example 1, it differs therefrom in the following points.

The difference lies in the fact that the developing roller surface roughness Ra is 1.5 μm, i.e., Ra/R=0.27, and that the charging polarity of the supply roller with respect to the toner is positive.

Comparative Example 3

While the developing apparatus of this comparative example is basically the same as that of Experimental Example 1, it differs therefrom in that the voltage applied to the supply roller with respect to the developing roller is 0V, and that the charging polarity of the supply roller with respect to the toner is positive.

Comparative Example 4

While the developing apparatus of this comparative example is basically the same as that of Experimental Example 1, it differs therefrom in that the charging polarity of the supply roller with respect to the toner is positive.

Method of Evaluation for Experimental Examples and Comparative Examples

Figure 4A:
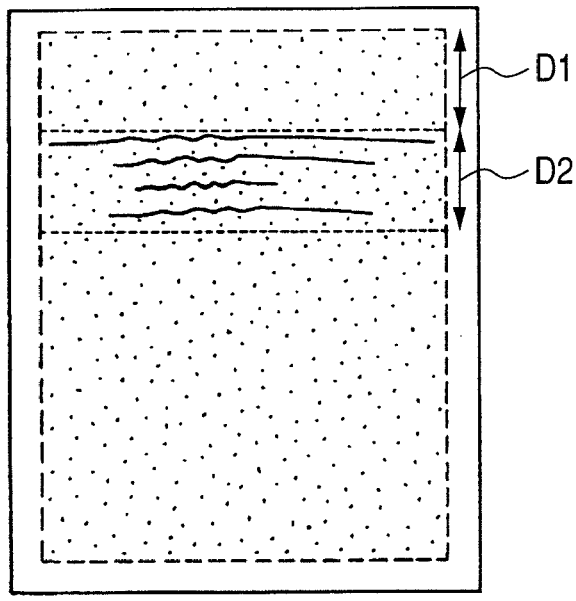
FIGS. 4A, 4B, and 4C are explanatory views illustrating a solid image and a generation mechanism thereof.
Figure 4B:
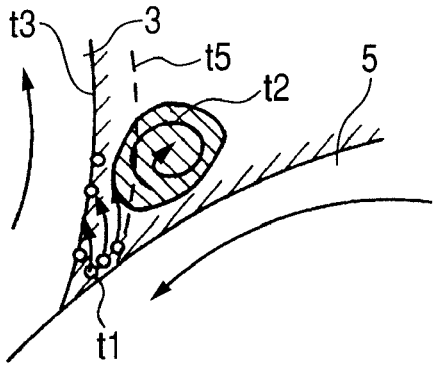
Figure 4C:
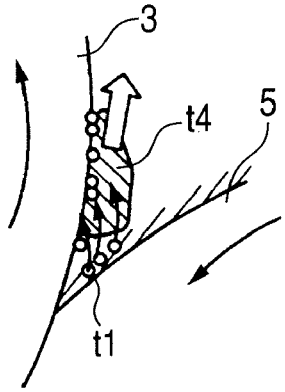

In the following, image evaluation for examining the difference between this Experimental Example and the comparative examples is described. Here, FIGS. 4A, 4B, and 4C are diagrams for illustrating a solid image and the generation mechanism thereof. FIG. 4A is a diagram illustrating a condition under which, when a solid image is printed, a wave-like difference in density is generated as a solid image failure at a position corresponding to the second round of the developing roller (section D2). FIG. 4B is a diagram for illustrating how toner is supplied from the developing roller 3 to the supply roller 5 during low printing or non-printing. FIG. 4C is a diagram for illustrating a case in which a solid image, which is a high printing image, is printed in the condition illustrated in FIG. 4B.

(a) Solid Image Density Difference Evaluation in Initial Stage of Printing

For image evaluation, ten solid images were output successively, and evaluation was made from the difference in density between the output forward end and rear end of the tenth solid image by using a Spectrodensitometer 500 manufactured by X-Rite Co., Ltd. In the printer of each example, image recording was performed by using a 600 dpi laser scanner.

Here, image evaluation was made by the following standards:

x: The difference in density between the output forward end and rear end of the solid image is not less than 0.2.

○: The difference in density between the output forward end and rear end of the solid image is less than 0.2.

The solid image density difference evaluation was made after the printing of 100 sheets in an evaluation environment of 15.0° C. and 10% Rh. The printing test was conducted by successively passing recording images of a horizontal line of an image ratio (coverage rate) of 5%.

(b) Image Uniformity Evaluation

Image uniformity evaluation was made through output of a solid image and a halftone image. When the uniformity deteriorates, sand-like dots (0.1 mm or less) of low density are generated in the uniform image. When it further deteriorates, there is generated an elliptical dot elongated in the developing roller rotating direction.

The presence/absence of these dots was examined visually, and image density uniformity evaluation was made by the following standards:

xx: Sand-like dots and elliptical dot are observed in the solid image and the halftone image.

x: Sand-like dots are observed in the solid image and the halftone image.

Δ: Sand-like dots are observed in one of the solid image and the halftone image.

○: Sand-like dots are observed in none of the solid image and the halftone image.

Image uniformity evaluation was made after the printing of 1000 sheets in an evaluation environment of 15.0° C. and 10% Rh. The printing test was conducted by successively passing horizontal line recording images of an image ratio of 5%.

(c) Fog Evaluation after Endurance

Fog is an image failure in which toner is slightly developed in a blank portion (unexposed portion) where no printing is to be effected, thus soiling the background of an image.

Fog amount evaluation was made as follows: Optical reflectance due to a green filter was measured by an optical reflectance measuring machine (TC-6DS manufactured by Tokyo Denshoku CO., LTD), and was subtracted from the reflectance of the recording material only to thereby obtain the reflectance amount corresponding to the fog, which was evaluated as the fog amount. For the fog amount, measurement was performed at more than ten points on the recording material to obtain the average value.

In Table 1, the symbols x, Δ, and ○ respectively indicate the following conditions:

x: The fog amount exceeds 2%.

Δ: The fog amount is 1 to 2%.

○: The fog amount is less than 1.0%.

The fog evaluation was made after printing of 20,000 sheets in a test environment of 30° C. and 80% Rh. The printing test was conducted by successively passing horizontal line recording images of an image ratio of 5%. When some other type of image failure described below is generated, the portions in question were avoided in the measurement, thus effecting net evaluation of the fog.

(d) Ghost Image Failure Evaluation after Endurance

Taking into account the peripheral speed of the developing roller and the process speed, a ghost image appearing at the developing roller cycle was evaluated. More specifically, the ghost image failure evaluation was made as follows: solid patch images of 5 mm square and 25 mm square were printed at the leading end portion of the recording material; when, after that, a difference in density appearing in the first round of the developing roller cycle in the halftone image was visually observed, it was determined that there was ghost image failure. In the printer of each example, image recording was performed by using a 600 dpi laser scanner. In this evaluation, the halftone image refers to a stripe pattern formed by recording one line in the main scanning direction and then leaving the succeeding four lines unrecorded; it exhibits as a whole a halftone density.

Here, the image evaluation was made by the following standards:

x: Ghost is observed in both patches.

Δ: Ghost is observed in one of the patches.

○: Ghost is observed in none of the patches.

Ghost evaluation was made after the printing on 20,000 sheets in an evaluation environment of 15.0° C. and 10% Rh. The printing test was conducted by successively passing horizontal line recording images of an image ratio of 5%.

(e) Solid Image Failure Evaluation

Taking into consideration the peripheral speed of the developing roller and the process speed, solid image failure appearing at the developing roller cycle was evaluated. More specifically, as illustrated in FIG. 4A, a solid image was printed, and when a wave-like density difference generated at a position corresponding to the second cycle of the developing roller (section D2) was visually observed, it was determined that there was solid image failure.

x: Solid image failure is observed.

○: No solid image failure is observed.

Solid image failure evaluation was made after the printing on 20,000 sheets in an evaluation environment of 15.0° C. and 10% Rh. The printing test was conducted by successively passing horizontal line recording images of an image ratio of 5%.

Table 1 illustrates the evaluation results of this Experimental Example and Comparative Examples 1 through 4.

TABLE 1

| Table 1 | Toner volume-average particle diameter R [μm] | Developing roller roughness Ra [μm] | Ra/R | Supply roller application voltage with respect to developing roller [V] | Supply roller surface charging polarity with respect to toner | (a) Solid density difference evaluation at initial stage | (b) Image uniformity evaluation | (c) Fog evaluation after endurance | (d) Ghost evaluation after endurance | (e) Solid image failure evaluation |
|---|---|---|---|---|---|---|---|---|---|---|
| Experimental Example 1 | 5.5 | 0.1 | 0.02 | −400 | Negative | ○ | ○ | ○ | ○ | ○ |
| Comparative Example 1 | 7.0 | 3.0 | 0.43 | −400 | Positive | ○ | xx | x | x | ○ |
| Comparative Example 2 | 5.5 | 1.5 | 0.27 | −400 | Positive | ○ | x | x | x | ○ |
| Comparative Example 3 | 5.5 | 0.1 | 0.02 | 0 | Positive | x | Δ | Δ | ○ | ○ |
| Comparative Example 4 | 5.5 | 0.1 | 0.02 | −400 | Positive | ○ | ○ | ○ | x | x |

(Advantages Over Related-Art Techniques)

First, the advantages of this Experimental Example are described through comparison of this Experimental Example with Comparative Example 1, which is a related-art technique.

In Comparative Example 1, the surface roughness of the developing roller with respect to the toner average particle diameter is very large. Thus, the toner coat layer is subject to fluctuation due to the roughness of the developing roller. As a result, a dot elongated in the direction of the developing roller is generated, resulting in a rather poor image uniformity. Further, due to the very large roughness of the developing roller, a locally high stress is applied to the toner as a result of pressurization and rubbing between the developing roller and the photosensitive drum or between the developing roller and the supply roller. As a result, degeneration of the toner is likely to occur, resulting in an increase in fog amount after endurance and generation of ghost image failure.

In contrast, in this Experimental Example, it is possible to maintain image uniformity and markedly suppress an increase in fog amount after endurance and generation of ghost image failure. That is, it is possible to obtain an image of high quality and in which image failure is suppressed from the initial stage of printing to when the number of sheets printed is increased.

(Advantages Over Comparative Techniques)

Next, the advantages of this Experimental Example are described through comparison of this Experimental Example with Comparative Examples 2 through 4.

<On (a) Solid Image Density Difference Evaluation Results at Initial Printing Stage and (b) Image Uniformity Evaluation Results>

In this Experimental Example and Comparative Example 4, the solid image density difference and the image uniformity are satisfactory.

Since the toner volume-average particle diameter R is as small as 5.5 μm, and Ra/R is 0.02, the fluctuation in the toner coat layer due to the roughness of the developing roller is diminished. As a result, the fluctuation at the time of the formation of the toner coat layer and the fluctuation in the development efficiency in the developing portion are markedly suppressed, so it is possible to achieve an improvement in image uniformity. In addition, a bias is applied between the developing roller and the supply roller that causes toner having an electric charge of normal charging polarity to be transferred to the developing roller side, so the toner supply property is stable. As a result, even in a case in which, after solid image printing of high development efficiency, supply of more toner is required, it is possible to maintain a sufficient supply amount, and the solid density difference is satisfactory.

In Comparative Example 2, although the toner volume-average particle diameter R is 5.5 μm as in this Experimental Example, the image uniformity is rather poor. This is due to the fact that ratio of the roughness of the developing roller surface with respect to the toner particle diameter, that is, Ra/R, is as large as 0.27, and that the toner coat layer is subject to fluctuation due to the surface roughness of the developing roller. As a result, the uniformity in image density is rather poor.

In Comparative Example 3, although the toner volume-average particle diameter R is 5.5 μm, and Ra/R is 0.02, the halftone image uniformity is somewhat poorer as compared with this Experimental Example. In Comparative Example 3, the bias applied between the developing roller and the supply roller is 0 V. Thus, it is to be assumed that the stability in the toner supply from the supply roller to the developing roller deteriorates. In addition, it is impossible to positively supply toner having electric charge of normal charging polarity, so there is also generated a fluctuation in the charge amount of the toner coat layer.

As a result, there is a slight deterioration in the image uniformity. Further, due to the poor toner supply property, the density difference is large also in a solid image of high development efficiency, which requires a more stable toner supply.

As described above, in this Experimental Example, the volume-average particle diameter is small, and the surface roughness of the developing roller is sufficiently small as compared with the toner particle diameter, so it is possible to form a uniform toner coat layer. In addition, a bias is applied between the developing roller and the supply roller which causes toner having an electric charge of normal charging polarity to be transferred to the developing roller side, so it is possible to stabilize the toner supply amount and the amount of electric charge of normal toner charging polarity. Thus, it is possible to form a more uniform toner coat layer. As a result, it is possible to attain superior image uniformity and to markedly suppress generation of a solid image density difference.

<On (c) Results of Fog Evaluation after Endurance and (d) Results of Ghost Evaluation after Endurance>

First, the cause of the generation of fog after endurance is described.

The toner in the developing portion is under high stress due to pressurization and rubbing between the photosensitive drum and the developing roller. In addition, the toner in the supply portion is also under high stress due to the pressurization and rubbing between the developing roller and the supply roller. Thus, the extraneous additive, such as silica covering the toner, is likely to be embedded in the toner or separated from the toner. Then, the charging property of the toner markedly deteriorates as compared with that in the initial stage of printing. That is, a toner coat layer of a small electric charge amount is formed, so the electrical binding force for the toner, whose electric charge amount is small, is weakened. As a result, due to the reduction in electrical binding force, the toner on the developing roller is likely to be transferred onto the photosensitive drum when it is brought into contact therewith, resulting in an increase in fog amount.

Further, it is to be assumed that, when the toner is brought into contact with an object, the extraneous additive, which exists between the toner and the object, reduces the adhesion force exerted therebetween. Thus, the generation of embedding or separation of the toner results in an increase in the adhesion force exerted between the toner and the object. As a result, the adhesion force of the toner with respect to the photosensitive drum is markedly increased, so the toner is transferred onto the photosensitive drum more easily.

In this Experimental Example, there is advantageously no increase in fog amount after endurance. It is to be assumed that this is due to the fact that the ratio of the arithmetic mean surface roughness of the developing roller surface with respect to the volume-average particle diameter of the toner, Ra/R, is as small as 0.02. When the ratio of the developing roller surface roughness with respect to the toner particle diameter is small, it is to be assumed that, at the time of pressurization and rubbing between the developing roller and the photosensitive drum or between the developing roller and the supply roller, the toner is likely to move on the developing roller in a direction in which a reduction in stress results. That is, it is possible to markedly suppress generation of a specific toner markedly degenerated under high local stress.

In addition, it is to be assumed that an increase in fog amount is suppressed through application between the developing roller and the supply roller of a bias which causes toner with an electric charge of normal charging polarity to be transferred to the developing roller side. By applying the above-mentioned bias, toner with a large normal charging polarity electric charge amount is more effectively supplied, so it is possible to suppress the supply of toner with small charging amount and toner of a reverse polarity, thus suppressing an increase in fog amount.

In Comparative Example 2, the ratio of the roughness of the developing roller surface with respect to the toner volume-average particle diameter is large, so, at the time of pressurization and rubbing between the developing roller and the photosensitive drum and between the developing roller and the supply roller, the toner on the developing roller is under a locally high stress. That is, it is to be assumed that, while the toner on the developing roller is inclined to move on the developing roller in a direction in which a reduction in stress results upon receiving high stress, because the developing roller surface roughness is large as compared with the average particle diameter of the toner, such a movement is hindered. As a result, a specific portion of the toner undergoes marked degeneration, resulting in an increase in fog amount.

Further, Comparative Example 2 involves ghost failure after endurance.

The reason for the generation of ghost image failure is illustrated below.

The ghost image failure is an image failure attributable to development history, and is generated at the cycle of the developing roller. In this Experimental Example, there is provided a supply roller. This supply roller has the function of temporarily separating toner remaining on the developing roller without being used for development, and, at the same time, has the function of supplying new toner. Thus, it is to be assumed that it is little influenced by the development history and does not easily generate image failure attributable thereto. However, it is to be assumed that, when the adhesion force exerted between the developing roller and the toner markedly increases due to degeneration of the toner, etc., the separating effect of the supply roller is reduced, resulting in generation of ghost image failure.

More specifically, after blank printing when the toner is degenerated, the amount of toner remaining without being consumed is larger as compared with the state after solid printing, so the amount of toner that cannot be separated by the supply roller and that remains on the developing roller increases. Since the amount of toner remaining without being separated is large, the proportion of the toner newly supplied by the supply toner decreases.

On the other hand, after solid printing, the amount of toner remaining on the developing roller after development is small, which means the amount of residual toner on the developing roller is small, so, as compared with the case of blank printing, the proportion of toner supplied is smaller. That is, when the toner is degenerated, the ratio of the amount of toner supplied differs between the state after blank printing and the state after solid printing. As a result, there is generated a change in the thickness of the toner coat layer and the electric charge distribution state. When a halftone image is printed with a toner coat layer with such development history, there is generated a difference in density under the influence of the development history of the previous round, resulting in ghost image failure.

In Comparative Example 2, it is to be assumed that the toner is markedly degenerated, and that the adhesion force between the developing roller and the toner increases, with the result that the separating effect of the supply roller is reduced, resulting in generation of ghost image failure.

As in this Experimental Example, in Comparative Example 3, the ratio of the developing roller surface roughness with respect to the toner volume-average particle diameter, Ra/R, is as small as 0.02, so it is to be assumed that the degeneration of the toner only occurs to a small degree. However, there is involved a slight increase in fog amount. It is to be assumed that this is due to the fact that, because the bias applied to the developing roller and the supply roller is 0 V, the proportion of supply toner with an electric charge of normal charging polarity is smaller as compared with that in this Experimental Example. That is, it is to be assumed that, because the proportion of uncharged toner or toner of reverse polarity in the toner coat layer increases, there is involved a slight increase in fog amount.

In Comparative Example 4, as in this Experimental Example, the ratio of the developing roller surface roughness with respect to the toner volume-average particle diameter, Ra/R, is as small as 0.02, so degeneration of toner only occurs to a small degree. Further, because a bias is applied between the developing roller and the supply roller which causes toner with an electric charge of normal charging polarity to be transferred to the developing roller side, it is possible to effectively supply toner with an electric charge of normal charging polarity to the developing roller, so an increase in fog amount after endurance is markedly suppressed. However, there is involved, to a marked degree, ghost image failure after endurance.

In the following, the reason for this is illustrated.

In Comparative Example 4, an electrical adhesion force is predominant between the developing roller and the toner, so a stable toner coat layer is formed. However, because an electrical adhesion force is predominant, it is to be assumed that the adhesion force between the developing roller and the toner is very strong. In addition, when it is rubbed against the toner, the supply roller of Comparative Example 4 imparts such an electric charge to the toner as is set to normal charging polarity. Thus, a toner layer of a still larger electric charge amount is formed on the developing roller, and it is difficult to separate the toner on the developing roller. As a result, it is to be assumed that the separating effect due to the supply roller is reduced to a marked degree, resulting in generation of ghost image failure after endurance.

On the other hand, in this Experimental Example, although there is formed a toner layer in which an electrical adhesion force is predominant, no ghost image failure after endurance is generated. It is to be assumed that this is due to the fact that, when it is rubbed against the toner, the supply roller of Experimental Example 1 imparts such an electric charge to the toner as is set to a polarity reverse to normal charging polarity. That is, it is possible to reduce the electric charge amount of the toner, whose electric charge amount has been markedly increased through rubbing between the toner and the supply roller at the abutment portion between the developing roller and the supply roller, so deterioration in the separation property is suppressed.

Further, in this Experimental Example, even if there is generated, through rubbing between the supply roller and the toner, toner with an electric charge of a polarity reverse to normal charging polarity, an increase in fog amount is suppressed. It is to be assumed that this is due to the fact that there is applied between the developing roller and the supply roller a bias which causes toner with an electric charge of normal charging polarity to be transferred to the developing roller side. It is to be assumed that, due to the application of the above-mentioned bias, toner of the reverse polarity moves to the supply roller side, and that the toner with an electric charge of normal charging polarity is supplied to the developing roller side, so an increase in fog amount is suppressed.

As described above, in this Experimental Example, the ratio of the arithmetic surface roughness of the developing roller surface with respect to the toner volume-average particle diameter is sufficiently small, so degeneration of the toner only occurs to a small degree. Further, by applying between the developing roller and the supply roller a bias which causes toner with an electric charge of normal charging polarity to be transferred to the developing roller side, supply of uncharged toner and toner of a reverse polarity are suppressed, so fog after endurance is suppressed to a marked degree.

As a result, the electrical adhesion force between the developing roller and the toner is increased. Thus, even when the separation of the supply roller is difficult, because the polarity of the toner is reversed when the supply roller surface is rubbed against the toner, generation of toner with a markedly high electric charge amount is suppressed, thus suppressing generation of toner firmly attached to the developing roller by an electrical force. Thus, it is possible to markedly suppress ghost image failure due to deterioration in the separation property of the supply roller. In addition, due to the application of the above-mentioned bias, even if there is generated toner with an electric charge of reverse polarity, supply of such toner to the developing roller is suppressed, so no image failure, such as fog, is generated.

<(f) On Solid Image Failure Evaluation Results>

Next, solid image failure evaluation results are illustrated. As illustrated in FIG. 4A, the solid image failure is an image failure in which a wave-like unevenness in density extending in the longitudinal direction is generated from the second round (section D2) of the developing roller perimeter onward.

While such solid image failure is aggravated in Comparative Example 4, no solid image failure is generated in this Experimental Example and Comparative Examples 1 through 3. Thus, although the generation mechanism of this image failure has not been clarified, it is generally to be assumed that this image failure is caused by the following phenomenon.

After printing of a high print image during the first round of the developing roller perimeter (section D1), image failure is generated during the second round of the developing roller perimeter (section D2). As illustrated in FIG. 4B, during low printing or non-printing, the supply of toner from the supply roller to the developing roller is effected through transfer of toner portion t1 by an application bias. On the other hand, due to the formation of a wedge-like configuration near the abutment portion between the developing roller and the supply roller, there is generated a staying toner portion t2. When, at this time, there exists a sufficient amount of toner on the developing roller, toner portion t3 on the developing roller strongly adheres to the developing roller surface.

On the other hand, the mutual action between the toner portion t3 and the staying toner portion t2 is weaker as compared with the above-mentioned adhesion force. Thus, as illustrated in FIG. 4B, it is to be assumed that the staying toner portion t2 is formed such that a specific toner portion curls up. As illustrated in FIG. 4C, when, in this state, a solid image, which is a high print image, is printed, the toner on the developing roller is reduced. As a result, the staying toner portion t2 is more often brought into direct contact with the developing roller, so it can be easily transferred onto the developing roller as indicated at t4. As a result, it is to be assumed that a fluctuation in supply amount is caused, thereby generating solid image failure.

It is to be assumed that solid image failure is not easily generated in Comparative Examples 1 and 2 because the ratio of the surface roughness of the developing roller with respect to the toner average particle diameter is large. As indicated by the toner portion t5 on the developing roller (dashed line) in FIG. 4B, in Comparative Examples 1 and 2, due to the large surface roughness of the developing roller, the layer thickness of the toner supplied is expected to be larger than that in Comparative Example 4. Then, the mutual action between the staying toner portion t2 and the toner portion t5 on the developing roller is enhanced. As a result, the staying toner portion t2 is formed so as to be easily loosened, so a fluctuation in toner supply is not easily generated.

In Comparative Example 3, solid image failure is not easily generated although the ratio of the surface roughness of the developing roller with respect to the toner average particle diameter is small. It is to be assumed that this is due to the fact that, in Comparative Example 3, the difference in bias between the developing roller and the supply roller is 0 V. More specifically, it is to be assumed that the staying toner portion t2 is gradually increased in electric charge amount due to triboelectrification as a result of its coming into contact with the developing roller and the supply roller. Alternatively, it is to be assumed that the electric charge gradually increases due to the formation of the staying toner portion after returning the toner supplied onto the developing roller to the supply portion and then separating it by the supply roller.

However, in Comparative Example 3, the application bias between the developing roller and the supply roller is 0 V, so the staying toner portion t2 with electric charge does not easily receive the action of an electric field; thus, it is to be assumed that a fluctuation in toner supply due to the staying toner portion t2 is not easily generated.

As described above, in Comparative Example 4, solid image failure is generated due to the fact that the surface roughness of the developing roller is sufficiently smaller as compared with the toner average particle diameter, which is likely to lead to generation of the staying toner portion t2. Further, the staying toner portion t2 easily takes electric charge, so there is applied between the developing roller and the supply roller a bias which causes toner with an electric charge of normal charging polarity to be transferred; thus, a fluctuation in the supply amount due to the staying toner portion t2 is likely to occur.

On the other hand, in this Experimental Example, no solid image failure is generated although, as in Comparative Example 4, the surface roughness of the developing roller is sufficiently smaller as compared with the toner average particle diameter, and there is applied between the developing roller and the supply roller a bias which causes toner with an electric charge of normal charging polarity to be transferred.

It is to be assumed that this is due to the fact that the supply roller has a charging polarity which makes the polarity of toner reverse to normal charging polarity when the toner is rubbed against the supply roller surface.

Thus, it is to be assumed that gradual attainment of normal charging amount through triboelectrification of the staying toner portion t2 and the supply roller is suppressed. As a result, it is to be assumed that even when a bias is applied such that toner is supplied from the supply roller to the developing roller, no solid image failure is generated.

As described above, in this Experimental Example, the surface roughness of the developing roller is sufficiently smaller as compared with the toner average particle diameter, and there is applied between the developing roller and the supply roller a bias which causes toner with an electric charge of normal charging polarity to be transferred, whereby it is possible to markedly suppress generation solid image failure.

(Relationship Between Ratio of Developing Roller Surface Roughness to Toner Volume-Average Particle Diameter, Ra/R, and Abutment Width S of Developing Roller and Supply Roller)

In the following, Experimental Examples 2 through 6 and Comparative Examples 5 through 10 are described in order to clarify the relationship between the ratio of the developing roller surface roughness to the toner volume-average particle diameter, Ra/R, and the abutment width S of the developing roller and the supply roller.

Experimental Examples 2, 3, 4, 5, and 6

Experimental Examples 2, 3, 4, 5, and 6, which are basically the same as Experimental Example 1, differ therefrom in the following points: that the respective toner volume-average particle diameters R of Experimental Examples 2, 3, 4, 5, and 6 are 6.0, 5.5, 6.0, 6.0, and 5.5 μm; that the respective arithmetic surface roughnesses Ra of the developing rollers of Experimental Examples 2, 3, 4, 5, and 6 are 0.24, 0.20, 0.30, 0.58, and 0.55 μm; that, in this case, the respective ratios of the developing roller surface arithmetic mean roughness to the toner volume-average particle diameter, Ra/R, of Experimental Examples 2, 3, 4, 5, and 6 are 0.040, 0.036, 0.050, 0.097, and 0.100; further, that the hardness of the supply roller and its forcing-in amount (inroad amount) of the supply roller with respect to the developing roller were adjusted such that the abutment pressure of the force the developing roller receives from the supply roller is 0.040 N/m, which is the same as that in Experimental Example 1; more specifically, that the respective hardnesses of the supply rollers of Experimental Examples 2, 3, 4, 5, and 6 are 0.064, 0.028, 0.040, 0.064, and 0.028; that the respective inroad amounts of the supply rollers with respect to the developing rollers of Experimental Examples 2, 3, 4, 5, and 6 are 1.0, 0.6, 1.5, 1.0, 0.6, and 1.5 mm; and that, in this case, the respective abutment widths S of the developing rollers and the supply rollers of Experimental Examples 2, 3, 4, 5, and 6 are 4.0, 2.5, 5.5, 4.0, 2.5, and 5.5 mm.

Comparative Examples 5, 6, 7, 8, 9, and 10

Comparative Examples 5, 6, 7, 8, 9, and 10, which are basically the same as Experimental Example 1, differ therefrom in the following points: that the respective toner volume-average particle diameters R of Comparative Examples 5, 6, 7, 8, 9, and 10 are 5.5, 6.0, 6.0, 5.5, 5.5, and 5.5 μm; that the respective arithmetic surface roughnesses Ra of the developing rollers of Comparative Examples 5, 6, 7, 8, 9, and 10 are 0.35, 0.30, 0.65, 0.65, 0.58, and 0.10 μm; that, in this case, the respective ratios of the developing roller surface arithmetic mean roughness to the toner volume-average particle diameter, Ra/R, of Comparative Examples 5, 6, 7, 8, 9, and 10 are 0.064, 0.050, 0.108, 0.118, 0.105, and 0.018; further, that the hardness of the supply roller and its forcing-in amount (inroad amount) of the supply roller with respect to the developing roller were adjusted such that the abutment pressure of the force the developing roller receives from the supply roller is 0.040 N/m, which is the same as that in Experimental Example 1; more specifically, that the respective hardnesses of the supply rollers of Comparative Examples 5, 6, 7, 8, 9, and 10 are 0.020, 0.084, 0.020, 0.084, 0.040, and 0.084; that the respective inroad amounts of the supply rollers with respect to the developing rollers of Comparative Examples 5, 6, 7, 8, 9, and 10 are 1.8, 0.4, 1.8, 0.4, 1.0, and 0.4 mm; and that, in this case, the respective abutment widths S of the developing rollers and the supply rollers of Comparative Examples 5, 6, 7, 8, 9, and 10 are 6.0, 2.0, 6.0, 2.0, 4.0, and 2.0 mm.

(Evaluation Method)

Of the above-mentioned evaluation items, image evaluation is made on (b) halftone image density and uniformity, (c) fog amount after endurance, (d) ghost image failure after endurance, and (e) solid image failure. The evaluation methods and evaluation standards are the same as those described above.

(Evaluation Results)

Table 2 illustrates the evaluation results of Experimental Examples 1 through 6 and Comparative Examples 5 through 10.

TABLE 2

| Table 2 | Toner volume-average particle diameter R [μm] | Developing roller roughness Ra [μm] | Supply roller hardness when inroad amount is 1.0 mm [N/mm] | Inroad amount of supply roller with respect to developing roller [mm] | Ra/R | Abutment width S of developing roller and supply roller [mm] | (b) Image uniformity evaluation | (c) Fog evaluation after endurance | (d) Ghost evaluation after endurance | (e) Solid image failure evaluation |
|---|---|---|---|---|---|---|---|---|---|---|
| Experimental Example 1 | 5.5 | 0.10 | 0.040 | 1.0 | 0.018 | 4.0 | ○ | ○ | ○ | ○ |
| Experimental Example 2 | 6.0 | 0.24 | 0.064 | 0.6 | 0.040 | 2.5 | ○ | ○ | ○ | ○ |
| Experimental Example 3 | 5.5 | 0.20 | 0.028 | 1.5 | 0.036 | 5.5 | ○ | ○ | ○ | ○ |
| Experimental Example 4 | 6.0 | 0.30 | 0.040 | 1.0 | 0.050 | 4.0 | Δ | ○ | ○ | ○ |
| Experimental Example 5 | 6.0 | 0.58 | 0.064 | 0.6 | 0.097 | 2.5 | Δ | ○ | ○ | ○ |
| Experimental Example 6 | 5.5 | 0.55 | 0.028 | 1.5 | 0.100 | 5.5 | Δ | ○ | ○ | ○ |
| Comparative Example 5 | 5.5 | 0.35 | 0.020 | 1.8 | 0.064 | 6.0 | Δ | x | ○ | ○ |
| Comparative Example 6 | 6.0 | 0.30 | 0.084 | 0.4 | 0.050 | 2.0 | Δ | ○ | x | x |
| Comparative Example 7 | 6.0 | 0.65 | 0.020 | 1.8 | 0.108 | 6.0 | x | x | x | ○ |
| Comparative Example 8 | 5.5 | 0.65 | 0.084 | 0.4 | 0.118 | 2.0 | x | x | x | ○ |
| Comparative Example 9 | 5.5 | 0.58 | 0.040 | 1.0 | 0.105 | 4.0 | x | x | x | ○ |
| Comparative Example 10 | 5.5 | 0.10 | 0.084 | 0.4 | 0.018 | 2.0 | ○ | ○ | x | x |

<(b) Image Uniformity Evaluation Results>

Figure 5:
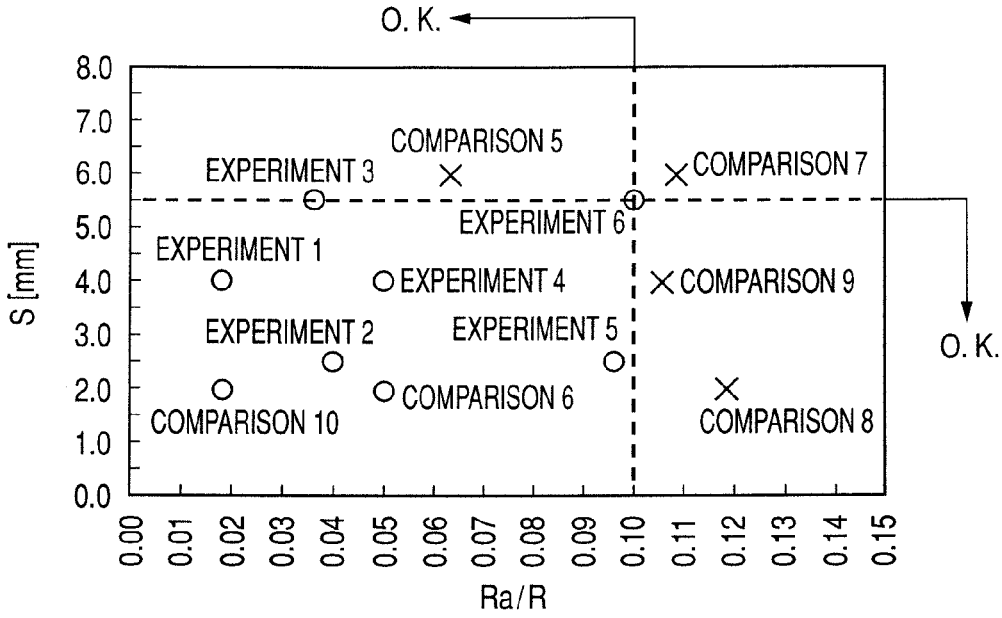
FIG. 5 is a diagram illustrating results of image density uniformity evaluation.

First, FIG. 5 illustrates the results of image density uniformity evaluation.

In Comparative Examples 7 through 9, the image uniformity is rather poor. On the other hand, in Experimental Examples 4 through 6, in which Ra/R≦1.0, an improvement in terms of uniformity is achieved. The reason for this is that the ratio of the developing roller surface roughness with respect to the toner particle diameter is sufficiently small as indicated by the formula: Ra/R≦1.0, which means the fluctuation in the toner coat layer due to the developing roller surface roughness is diminished. As a result, it is possible to markedly suppress the fluctuation involved at the time of formation of a uniform toner coat layer and the fluctuation in development efficiency in the developing portion, so an improvement in terms of image uniformity is achieved.

On the other hand, in Comparative Examples 7 through 9, the surface roughness of the developing roller with respect to the toner average particle diameter is large as indicated by the formula: Ra/R>1.0, so the fluctuation in the toner coat layer due to the surface roughness of the developing roller is rather large; thus, a rather poor image uniformity is to be expected.

In Experimental Examples 1 through 3, the ratio of the developing roller surface roughness with respect to the toner particle diameter is sufficiently small as indicated by the formula: Ra/R≦0.04, so a further improvement in terms of uniformity is achieved. It is to be assumed that this is due to the fact that the uniformity of the toner coat layer is improved through attainment of the condition of Ra/R≦0.04 as in the above-mentioned case.

As described above, to improve the uniformity of the toner coat layer and to improve the uniformity of the image, it is desirable to attain the condition of Ra/R≦0.1 (which means the arithmetic mean roughness Ra of the surface of the developing roller 3 is not more than 0.10 times the volume-average particle diameter R of the toner). Further, it is more desirable to attain the condition of Ra/R≦0.04 (which means the arithmetic mean roughness Ra of the surface of the developing roller 3 is not more than 0.04 times the volume-average particle diameter R of the toner).

<(c) Results of Fog Evaluation after Endurance>

Figure 6:
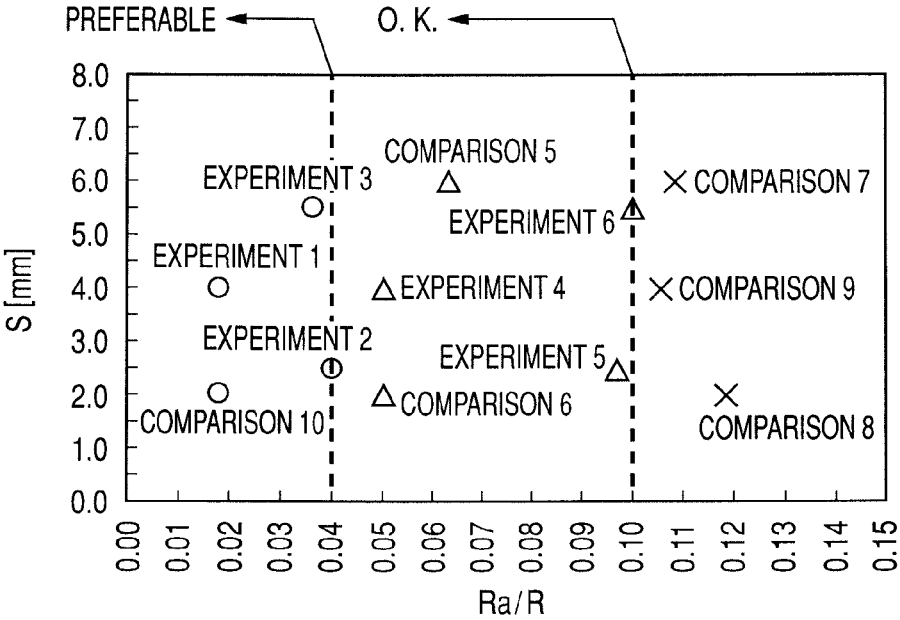
FIG. 6 is a diagram illustrating results of fog amount evaluation after endurance.

FIG. 6 illustrates the results of fog evaluation after endurance. Comparison of Comparative Examples 7 through 9 with Experimental Examples 5 and 6 illustrates that, in Comparative Examples 7 through 9, there is an increase in fog amount after endurance. The reason for this is that the ratio of the surface roughness of the developing roller with respect to the volume-average particle diameter of the toner is large as indicated by the formula: Ra/R>0.1, so the toner on the developing roller is under a locally high stress at the time of pressurization and rubbing between the developing roller and the photosensitive drum and between the developing roller and the supply roller.

That is, when under high stress, the toner on the developing roller is inclined to move on the developing roller in a direction in which a reduction in stress results; however, it is to be assumed that such a movement is hindered because the surface roughness of the developing roller is larger as compared with the toner average particle diameter. As a result, a specific portion of the toner is markedly degenerated, resulting in an increase in fog amount.

On the other hand, in Experimental Examples 1 through 6, the ratio of the surface roughness of the developing roller with respect to the toner particle diameter is small as indicated by the formula: Ra/R≦0.1. Thus, it is to be assumed that the toner can easily move on the developing roller in a direction in which a reduction in stress results at the time of pressurization and rubbing between the developing roller and the photosensitive drum or between the developing roller and the supply roller. That is, it is possible to markedly suppress generation of a specific toner portion markedly degenerated under a locally high stress. Thus, an increase in fog amount is markedly suppressed.

In Comparative Example 5, however, the fog amount after endurance is deteriorated even though Ra/R≦0.1. It is to be assumed that this is due to the fact that the abutment width S in which the developing roller and the supply roller abut each other is as large as 6.0 mm. The toner coat layer of this Experimental Example is formed in a state in which the toner firmly adheres electrically to the developing roller. To suppress generation of toner with a very high electric charge, the supply roller has a charging polarity which imparts electric charge to the toner with a polarity reverse to the normal charging polarity of the toner. However, it is to be assumed that, when the abutment width S in which the developing roller and the supply roller abut each other is too large, triboelectrification of the supply roller and the toner occurs more often, generating toner that is too much of a reverse polarity or that has no electric charge. This seemingly leads to generation of an increase in fog amount.

On the other hand, in Experimental Examples 1 through 6, in which the abutment width S, in which the developing roller and the supply roller abut each other, is not more than 5.5 mm, there is advantageously no increase in fog amount after endurance. It is to be assumed that, because the generation amount of toner charged to reverse polarity is small, an increase in fog amount is suppressed.

As described above, in this Experimental Example, by attaining the condition: Ra/R≦0.1, and adjusting the abutment width S of the developing roller and the supply roller to the range: S≦5.5 mm, it is possible to markedly suppress an increase in fog amount.

<(d) Results of Ghost Evaluation after Endurance>

Figure 7:
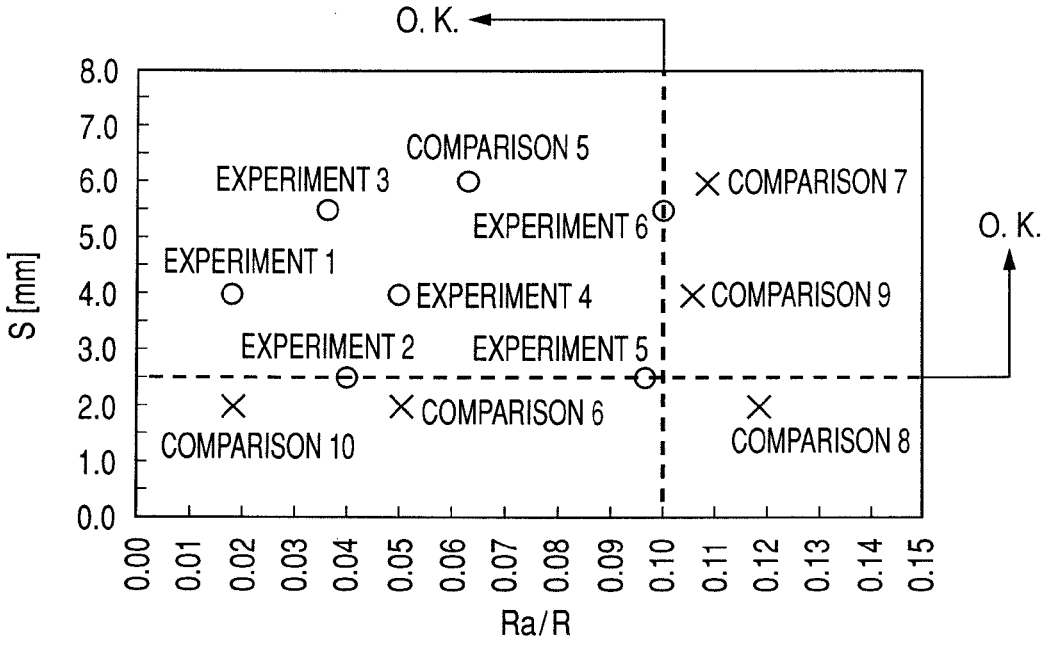
FIG. 7 is a diagram illustrating results of ghost image failure evaluation after endurance.

FIG. 7 illustrates the results of ghost image failure evaluation after endurance.

Comparison of Comparative Examples 7 through 9 with Experimental Examples 5 and 6 illustrates that, in Comparative Examples 7 through 9, ghost image failure after endurance is generated. The reason for this is that the ratio of the surface roughness of the developing roller with respect to the volume-average particle diameter of the toner is large as indicated by the formula: Ra/R>0.1, so the toner on the developing roller is under a locally high stress at the time of pressurization and rubbing between the developing roller and the photosensitive drum and between the developing roller and the supply roller.

That is, when under high stress, the toner on the developing roller is inclined to move on the developing roller in a direction in which a reduction in stress results; however, it is to be assumed that such a movement is hindered because the surface roughness of the developing roller is larger as compared with the toner average particle diameter. As a result, a specific portion of the toner is markedly degenerated, resulting in generation of ghost image failure after endurance.

However, in Comparison Examples 6 and 10, ghost image failure after endurance is generated although Ra/R≦0.1. It is to be assumed that this is due to the fact that the abutment width S in which the developing roller and the supply roller abut each other is as small as 2.0 mm. The toner coat layer of this embodiment is formed in a state in which the toner firmly adheres electrically to the developing roller. To suppress generation of toner having a very high electric charge, the supply roller has a charging polarity that imparts electric charge to the toner with a polarity reverse to the normal charging polarity of the toner. However, when the abutment width S in which the developing roller and the supply roller abut each other is too small, triboelectrification between the supply roller and the toner occurs less often, so it is to be assumed that it is impossible to suppress generation of toner having an excessive electric charge and firmly adhering to the developing roller. As a result, the separating effect of the supply roller is reduced, resulting in generation of ghost image failure after endurance.

On the other hand, in Experimental Examples 1 through 6, in which the abutment width S in which the developing roller and the supply roller abut each other is not less than 2.5 mm, ghost image failure after endurance is suppressed. It is to be assumed that, because generation of toner with excessive electric charge is markedly suppressed, ghost image failure after endurance is suppressed.

<Results of Comprehensive Evaluation of (b) Image Uniformity, (c) Fog after Endurance, and (d) Ghost after Endurance>

Figure 8:
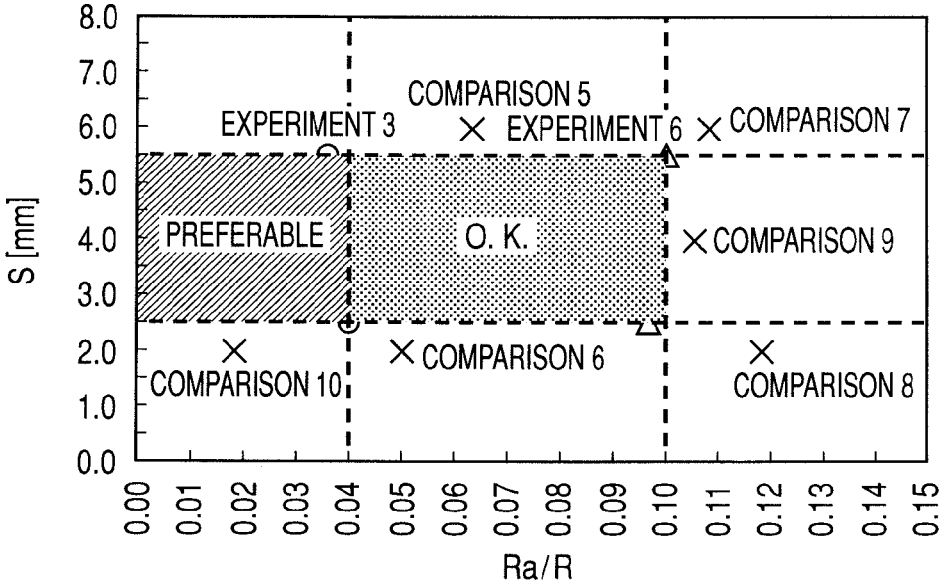
FIG. 8 is a diagram illustrating results of comprehensive evaluation of image uniformity, fog after endurance, and ghost image failure after endurance.

FIG. 8 illustrates the results of comprehensive evaluation of (b) image uniformity, (c) fog after endurance, and (d) ghost after endurance.

To suppress the fog amount after endurance and ghost after endurance while maintaining the image uniformity, the range as illustrated in FIG. 8 is preferable. That is, it is desirable that the abutment width S in which the developing roller and the supply roller abut each other be in the range: $2.5 \leqq S \leqq 5.5$, and that the ratio of the arithmetic surface roughness of the developing roller surface to the toner volume-average particle diameter be in the range: $Ra/R \leqq 0.1$, more preferably, in the range: $Ra/R \leqq 0.04$.

<(e) Results of Solid Image Failure Evaluation>

Figure 9:
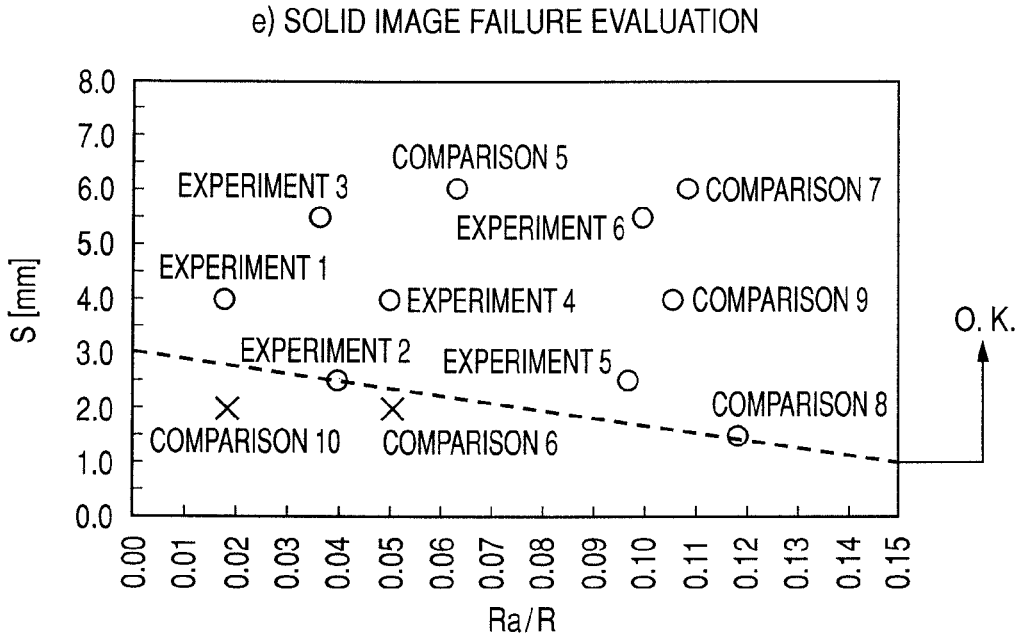
FIG. 9 is a diagram illustrating results of solid image failure evaluation.

FIG. 9 illustrates the results of solid image failure evaluation.

As stated above, it is to be assumed that solid image failure is generated through gradual attainment of the normal charging amount due to the triboelectrification of the staying toner portion t2 and the supply roller illustrated in FIG. 9. In Comparative Examples 6 and 10, as in the case of ghost image failure, $S<2.0$, so the number of times at which the supply roller comes into contact with the toner is insufficient; thus, it is to be assumed that the toner portion t2 gradually assumes normal charging polarity.

However, in Comparative Example 8, no solid image failure is generated although $S<2.0$. It is to be assumed that this is due to the fact that the ratio of the surface roughness of the developing roller with respect to the toner particle diameter, Ra/R, is large. It is to be assumed that, when the ratio of the surface roughness with respect to the toner particle diameter is large, due to the mutual action between the staying toner portion t2 and the toner portion t1 on the developing roller, a gradual increase in the charging amount of the toner portion t2 is suppressed. As a result, no solid image failure is generated.

That is, it is to be assumed that, the smaller the ratio of the surface roughness of the developing roller with respect to the toner particle diameter, Ra/R, is, the more likely it is for solid image failure to be generated. However, as can be seen from FIG. 9, in this embodiment, no solid image failure is generated due to the condition: $S \geqq 3.0-12.5\times(Ra/R)$. It is to be assumed that this is due to the fact that, because the number of times at which the toner comes into contact with the supply roller is sufficient, generation of excessively charged toner is suppressed.

As stated above, by attaining the condition: $S \geqq 3.0-12.5\times(Ra/R)$, it is possible to suppress solid image failure.

EFFECTS OF THE EMBODIMENT

As described above, according to this embodiment, toner can be supplied in a stable manner, so it is possible to obtain a high quality image which exhibits little solid image density difference and high image uniformity. Further, generation of markedly degenerated toner or toner with an excessive charging amount is markedly suppressed, so it is possible to markedly suppress an increase in fog amount after endurance, ghost image failure after endurance, and solid image failure. That is, it is possible to markedly suppress ghost image failure and solid image failure generated due to excessive charging of the toner as a result of an improvement in image quality.

Thus, it is possible to obtain a high quality image which is stable and free from image failure, irrespective of the number of sheets on which printing has been performed.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application Nos. 2007-1128315, filed May 14, 2007 and 2008-096419, filed Apr. 2, 2008, which is hereby incorporated by reference herein in its entirety.

What is claimed is:

1. A developing apparatus comprising:

a developer carrying member which carries a developer, a voltage being applied to the developer carrying member;

a developer amount regulating member which regulates the developer on the developer carrying member; and a developer supplying member provided so as to abut the developer carrying member to supply the developer to the developer carrying member, a voltage being applied to the developer supplying member, wherein the developer used has a volume-average particle diameter R that is in a range of $4.0\ \mu m \leqq R \leqq 6.2\ \mu m$, wherein a surface of the developer carrying member has an arithmetic mean roughness Ra (μm) that is not more than 0.10 times the volume-average particle diameter R of the developer, wherein a value which is defined by subtracting the voltage applied to the developer carrying member from the voltage applied to the developer supplying member is of a same polarity as a normal charging polarity of the developer on the developer carrying member after regulation by the developer amount regulating member, wherein a triboelectrification polarity of the developer supplying member with respect to the developer is of the same polarity as the normal charging polarity of the developer, and wherein, in a cross section taken in a direction in which the developer carrying member and the developer supplying member abut each other, an abutment width S in which the developer carrying member and the developer supplying member abut each other is in a range of $2.5\ mm \leqq S \leqq 5.5\ mm$.

2. A developing apparatus according to claim 1, wherein the arithmetic mean roughness Ra of the surface of the developer carrying member is not more than 0.04 times the volume-average particle diameter R of the developer.

3. A developing apparatus according to claim 1, wherein the abutment width S, the arithmetic mean roughness Ra of the surface of the developer carrying member, and the volume-average particle diameter R of the developer satisfy the following relationship:

$S \geqq 3.0-12.5\times(Ra/R)$.

4. An image forming apparatus comprising:

an image bearing member on which an electrostatic latent image is formed; and a developing apparatus which performs a developing action on the image bearing member, the developing apparatus comprising:

a developer carrying member which carries a developer, a voltage being applied to the developer carrying member;

a developer amount regulating member which regulates the developer on the developer carrying member; and a developer supplying member provided so as to abut the developer carrying member to supply the developer to the developer carrying member, a voltage being applied to the developer supplying member, wherein the developer used has a volume-average particle diameter R that is in a range of 4.0 μm≦R≦6.2 μm, wherein a surface of the developer carrying member has an arithmetic mean roughness Ra (μm) that is not more than 0.10 times the volume-average particle diameter R of the developer, wherein a value which is defined by subtracting the voltage applied to the developer carrying member from the voltage applied to the developer supplying member is of the same polarity as a normal charging polarity of the developer on the developer carrying member after regulation by the developer amount regulating, wherein a triboelectrification polarity of the developer supplying member with respect to the developer is of the same polarity as the normal charging polarity of the developer, and wherein, in a cross section taken in a direction in which the developer carrying member and the developer supplying member abut each other, an abutment width S in which the developer carrying member and the developer supplying member abut each other is in a range of 2.5 mm≦S≦5.5 mm.

5. An image forming apparatus according to claim 4, wherein the arithmetic mean roughness Ra of the surface of the developer carrying member is not more than 0.04 times the volume-average particle diameter R of the developer.

6. An image forming apparatus according to claim 4, wherein the abutment width S, the arithmetic mean roughness Ra of the surface of the developer carrying member, and the volume-average particle diameter R of the developer satisfy the following relationship:

$S \geqq 3.0-12.5\times(Ra/R)$.

7. A process cartridge in which a developing apparatus and an image bearing member are integrated and which is detachably mountable to an image forming apparatus main body, the process cartridge comprising:

the image bearing member on which an electrostatic latent image is formed; and the developing apparatus which performs developing action on the image bearing member, the developing apparatus comprising:

a developer carrying member which carries a developer, a voltage being applied to the developer carrying member;

a developer amount regulating member which regulates the developer on the developer carrying member; and a developer supplying member provided so as to abut the developer carrying member to supply the developer to the developer carrying member, a voltage being applied to the developer supplying member, wherein the developer used has a volume-average particle diameter R that is in a range of 4.0 μm≦R≦6.2 μm, wherein a surface of the developer carrying member has an arithmetic mean roughness Ra (μm) that is not more than 0.10 times the volume-average particle diameter R of the developer, wherein a value which is defined by subtracting the voltage applied to the developer carrying member from the voltage applied to the developer supplying member is of the same polarity as a normal charging polarity of the developer on the developer carrying member after regulation by the developer amount regulating member, wherein a triboelectrification polarity of the developer supplying member with respect to the developer is of the same polarity as the normal charging polarity of the developer, and wherein, in a cross section taken in a direction in which the developer carrying member and the developer supplying member abut each other, an abutment width S in which the developer carrying member and the developer supplying member abut each other is in a range of 2.5 mm≦S≦5.5 mm.

8. A process cartridge according to claim 7, wherein the arithmetic mean roughness Ra of the surface of the developer carrying member is not more than 0.04 times the volume-average particle diameter R of the developer.

9. A process cartridge according to claim 7, wherein the abutment width S, the arithmetic mean roughness Ra of the surface of the developer carrying member, and the volume-average particle diameter R of the developer satisfy the following relationship: $S \geqq 3.0-12.5\times(Ra/R)$.

* * * * *